US008251208B2

(12) United States Patent
Morrissey et al.

(10) Patent No.: US 8,251,208 B2
(45) Date of Patent: Aug. 28, 2012

(54) RETAIL DISPLAY OF FLAT ROLL GIFT WRAP PRODUCTS

(75) Inventors: Scott Morrissey, Phoenix, AZ (US); David E. Blinderman, Cleveland, OH (US); Joel Hageman, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 399 days.

(21) Appl. No.: 12/579,482

(22) Filed: Oct. 15, 2009

(65) Prior Publication Data

US 2010/0051485 A1 Mar. 4, 2010

Related U.S. Application Data

(63) Continuation-in-part of application No. 11/322,793, filed on Dec. 30, 2005, now abandoned.

(51) Int. Cl.
*B65D 85/672* (2006.01)

(52) U.S. Cl. ..... 206/225; 206/397; 206/410; 206/806; 211/45; 211/85.15

(58) Field of Classification Search ..... 206/410, 206/389, 397, 408, 223, 575, 225, 806, 776, 206/778, 775; 211/45, 49.1, 85.15, 72
See application file for complete search history.

(56) References Cited

U.S. PATENT DOCUMENTS 3,144,934 A * 8/1964 Shultz ..... 53/118
4,290,467 A * 9/1981 Schmidt ..... 383/9
4,899,879 A * 2/1990 Rosen ..... 206/445
4,909,388 A * 3/1990 Watanabe ..... 206/410
5,027,582 A * 7/1991 Dearwester ..... 53/399
5,267,643 A * 12/1993 Scribner ..... 383/17
5,269,421 A * 12/1993 Taylor ..... 206/411
5,692,834 A * 12/1997 Pagano ..... 383/9
5,894,708 A * 4/1999 Newby et al. ..... 53/438
5,938,013 A * 8/1999 Palumbo et al. ..... 206/210
6,220,436 B1 * 4/2001 Chung ..... 206/424
7,971,717 B2 * 7/2011 Eilert et al. ..... 206/391
2002/0166787 A1 * 11/2002 Linton ..... 206/497

* cited by examiner

*Primary Examiner* — Jacob K Ackun
(74) *Attorney, Agent, or Firm* — Roetzel & Andress

(57) ABSTRACT

A flat roll gift wrap package has an elongated form with planar opposed sides and convex arcuate transitions between the sides. Flexible material in sheet form, such as, for example, paper or plastic, can be wound about the form without formation of creases or folds at the arcuate transitions. Printed patterns applied to the flexible material in sheet form are visible in full or repeated one or more times on the material which extends over the planar opposed sides of the form. Multiple flat roll gift wrap packages are combined in display packages or envelopes, poly bags or boxes and stacked on the planar sides of the flat rolls or with the arcuate transitions of the flat rolls arranged side-by-side. Retail displays of flat roll gift wrap products include flat rolls of gift wrap sheet material contained in envelopes which are suspended or otherwise held in a generally vertical orientation upon a retail displays.

15 Claims, 8 Drawing Sheets

RETAIL DISPLAY OF FLAT ROLL GIFT WRAP PRODUCTS

RELATED APPLICATIONS

This patent application claims priority to and is a continuation-in-part of U.S. patent application Ser. No. 11/322,793, filed Dec. 30, 2005 now abandoned and entitled, "Flat Roll Gift Wrap Products". The aforementioned U.S. Patent Application is incorporated by reference herein in its entirety.

FIELD OF THE INVENTION

The present invention is in the general field of flexible products in sheet or planar form, including paper and other thin form materials which can be wound around a mandrel, tube or other form.

BACKGROUND OF THE INVENTION

Flexible sheet material, such as paper webs, textiles and polymer films are typically wound around cylindrical forms as a way of dense packaging for shipping and storage. Cylindrical forms such as tubes are easily handled in automated winding processes and can be placed on end for storage of rolls of material. Thin sheet paper is rolled in this manner in production and printing processes.

Cylindrical forms or mandrels for winding material can be made of steel, wood or wood pulp such as heavy or light gauge cardboard or polymeric or plastic material and sized appropriately for the intended application. Cylindrical forms have a diameter which represents bulk space or a void in shipping and storage. Also, the appearance of product and particularly graphical product available in rolled form can be difficult to visualize in its flat, planar state due to the less surface area that is visible along the viewing plane.

Conventional cylindrical roll wrap is typically stored within a box or bin located on the retail floor. Only a portion of the rolls stored around the perimeter of the container can be seen by the consumer. In order for a consumer to view the design or pattern contained upon a roll that is located behind the row of perimeter rolls, the consumer must physically lift each roll to determine the designed contained thereon. If the rolls are not organized by color or even by event, it could potentially take a consumer several minutes to locate a suitable roll for purchase, if at all. Also, cylindrical rolls are not easily displayed in any vertical arrangement such as on walls or display hooks.

SUMMARY OF THE INVENTION

The present invention provides a flat roll gift wrap product that includes sheet material, such as, for example, gift wrapping paper, and a form that has at least two planar sides joined by arcuate transitions about which sheet material is wound as a gift wrap unit. In an exemplary embodiment, a flat roll form has first and second opposed planar sides and arcuate transitions which form arcuate transitions between the first and second planar sides, and a flexible, sheet material is continuously wrapped about the flat roll form over the first and second planar sides and the arcuate transitions without any creases formed in the sheet material. A radius of the arcuate transitions can be as small as possible without resulting in formation of a crease in the sheet material along the portion of the area of the arcuate transitions. The sheet material can have graphic or other printed indicia on an exterior surface thereof which is oriented outward with respect to the flat roll form so that a substantial portion of the graphic on the sheet material is visible.

In another embodiment, the flat roll gift wrap product includes a flat roll unit of sheet material wound about a flat roll form, and an envelope for containing the gift wrap unit. In yet another embodiment, the flat roll gift wrap product includes a container that supports one or a plurality of gift wrap units. The container can further include at least one envelope each containing one or more flat roll units.

DESCRIPTION OF THE DRAWINGS

The various embodiments of the present invention can be understood with reference to the following drawings. The components in the drawings are not necessarily to scale. Also, in the drawings, like reference numerals designate corresponding parts throughout the several views.

DETAILED DESCRIPTION OF PREFERRED AND ALTERNATE EMBODIMENTS

Figure 1:
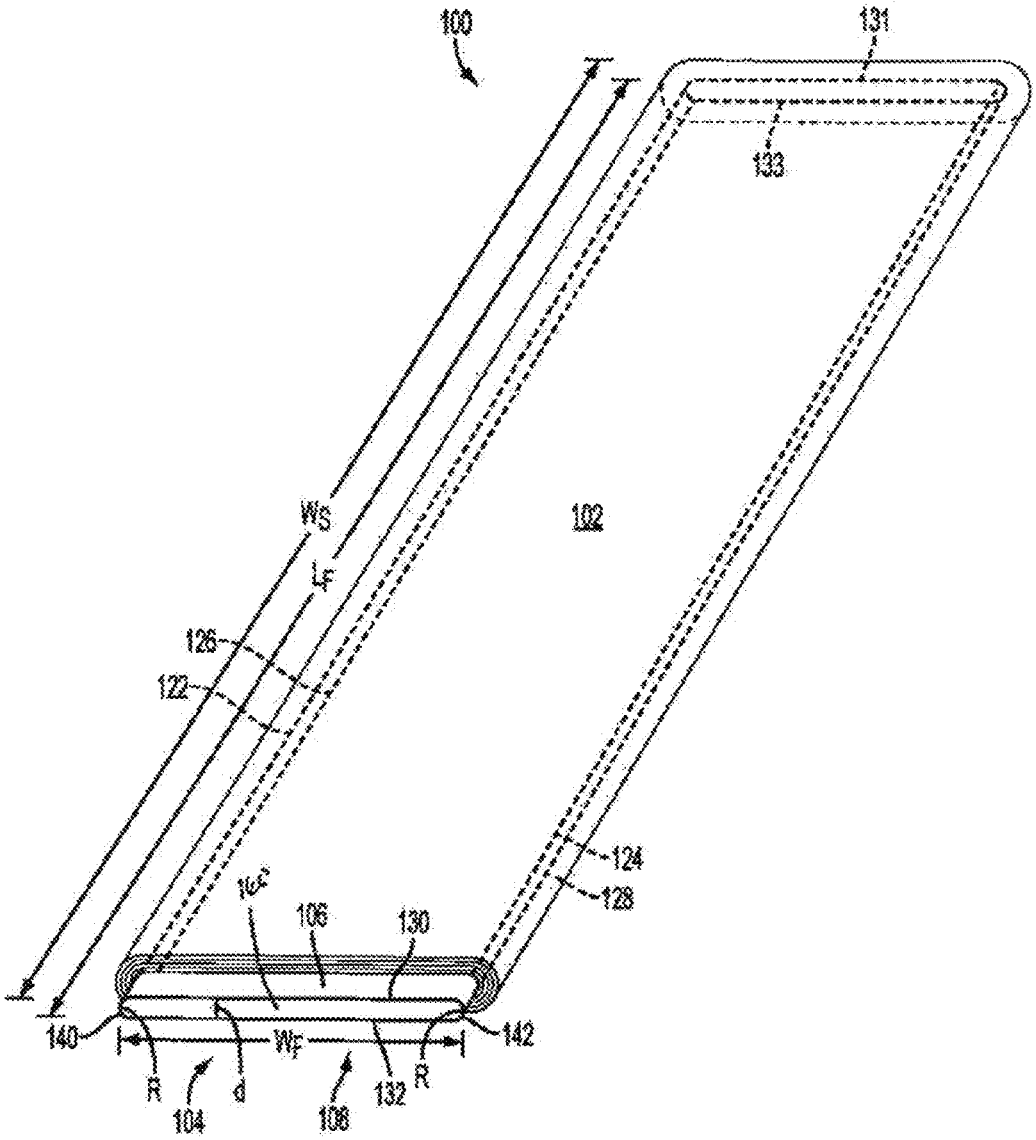
FIG. 1 is a perspective view of an embodiment of a flat roll gift wrap product which includes a flat roll gift wrap product which includes sheet material wound about a flat roll form having arcuate transitions, according to an embodiment of the invention.

As illustrated in the FIGS. 1 and 2, a flat roll gift wrap product, indicated generally at 100, is a compact assembly of sheet material 102 wound about a flat roll form 104. As used herein a "flat roll" of the flat roll form 104 refers to or means a generally elongate form which has at least one substantially planar or flat surface and about which a sheet material 102, such as, for example, paper or plastic, is wound one or more times.

In one embodiment FIG. 1 shows form 104 includes a first planar surface 106 that is generally rectangular, the first planar surface having a first side edge 122 opposed to a second side edge 124 and a first end 130 opposed to a second end 131. The second planar surface 108, which is shown substantially parallel to and spacially aligned with the first planar surface 106, is generally rectangular and has a first side edge 126 opposed to a second side edge 128 and a first end 132 opposed to a second end 133. A first arcuate transition 140 is disposed between the first side edge 122 of the first planar surface 106 and the first side edge 126 of the second planar surface 108, a second arcuate transition 142 disposed between the second side edge 124 of the first planar surface 106 and the second side edge 128 of the second planar surface 108. A sheet material 102 has a width $W_s$ that extends along the length $L_f$ of the flat roll form between, for example, the first end 130 and the second end 131 of the form. The sheet material has a length wound about the form such that portions of the sheet material located proximate to the first and second arcuate transitions 140, 142, of the form are curved.

By "arcuate" it is meant that the arcuate transitions 140, 142, have a profile or cross-sectional shape that is generally convex between the first planar surface 106 and the second planar surface 108. As shown in FIG. 1, the arcuate transitions 140, 142, have a radius, R, that can be substantially equal to one-half the distance, d, between the planar surfaces 106, 108. Stated differently, the diameter of the arcuate transitions is substantially equal to the distance, d, between the planar surfaces 106, 108. It should be understood, however, that various portions of the arcuate transitions 140, 142, can have varying radii. For example, the arcuate transitions can have a shape that is oval or oblong. Furthermore, first arcuate transition 140 can have a different profile shape than second arcuate transition 142.

Thus in the example embodiment of FIG. 1, the flat roll form 104 has two planar, parallel and opposed sides 106, 108, which are generally rectangular in shape, with parallel and aligned edges 130, 131, 132, 133, defining an overall length, $L_f$, of the flat roll form 104. The arcuate transitions 140, 142 adjoin the elongate edges 122, 124, 126, 128 of each of the opposed sides and are located laterally outboard of the elongate edges of planar surfaces 106, 108 and have an exterior convex profile which projects outwardly from core 160 of the flat roll form 104.

Figure 2A:
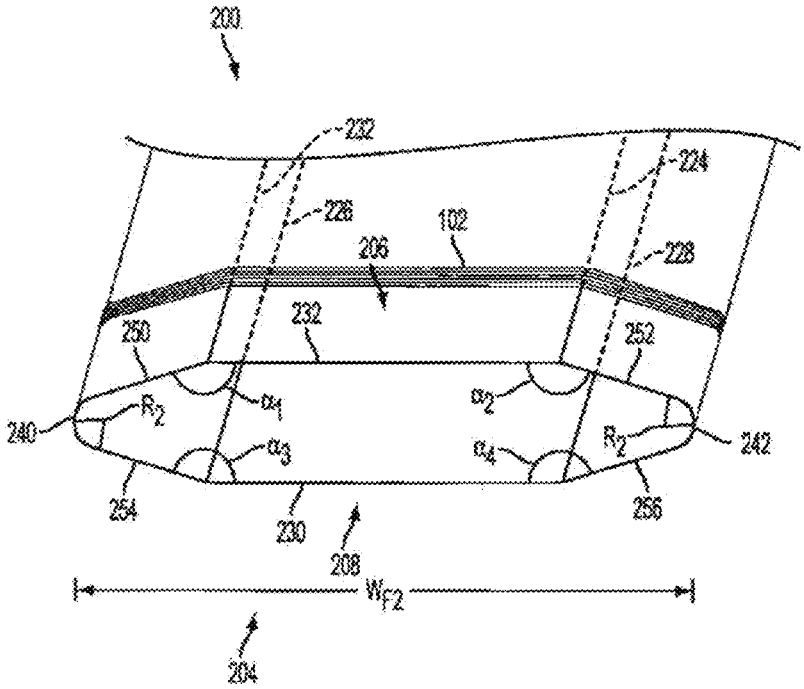
FIG. 2A is a perspective view of a flat roll gift wrap product which includes sheet material wound about a flat roll form having arcuate transitions that include planar segments, according to an embodiment of the invention.
Figure 2B:
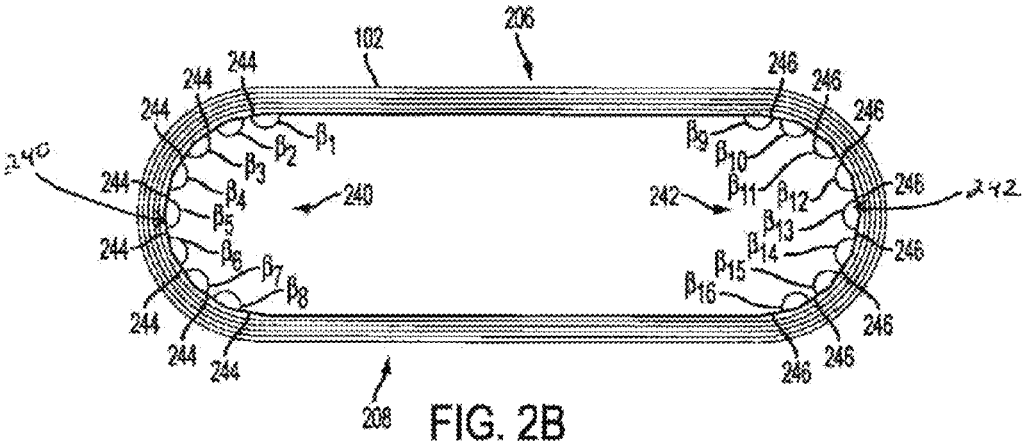
FIG. 2B is a cross-sectional view of a flat roll gift wrap product which includes sheet material wound about a flat roll form having arcuate transitions that include planar segments, according to an embodiment of the invention.

In alternative embodiments, as illustrated in FIGS. 2A and 2B, the arcuate transitions 240, 242, can include at least one planar segment, for example, planar segments 250, 252, 254, 256, which are angled relative to the first and second planar surfaces 206, 208 such that the profile of the arcuate transitions 240, 242, is generally convex and adjoins the substantially parallel and aligned planar surfaces 2046, 208. The example embodiment of the flat roll gift wrap product 200 shown in FIG. 2A has arcuate transitions 240, 242, portions of which include a combination of substantially planar segments 250, 252, 254, 256, and curved or radius surfaces 257, 258, having a radius $R_1$ and $R_2$, respectively. The planar surface segments are angled relative to the first and second planar surfaces 206, 208 by an angle, alpha, $\alpha$ 1-4, that can range from between about 90 degrees and about 180 degrees, and also, for example, from between about 120 degrees and about 150 degrees. In the example embodiment shown in FIG. 2B, the arcuate transitions 240, 242, of flat roll form have a plurality of substantially planar segments, each of which is oriented at an angle, beta, relative to its adjacent planar segments. The angle beta, $\beta$, can vary between each of the planar segments and can range from between about 90 degrees and about 180 degrees, and also for example, from between about 120 degrees and about 150 degrees.

Therefore, the arcuate transitions 140, 142, 240, 242, of FIGS. 1, 2A, and 2B above can include a combination of radiused surfaces and planar surface segments, and in alternative embodiments, can include a plurality of planar surface segments adjoined to form a generally convex profile between the first and second planar surfaces 240, 242. The flat roll gift wrap products 100, 200, of FIGS. 1, 2A and 2B have arcuate transitions that ensure that the sheet material proximate to the arcuate transitions of the flat roll form has no crease, for example a crease along the length of the form, Lf.

As apparent from FIG. 1, the distance between the ends of the planar surfaces 106, 108, can be greater than the between the side edges. Also, a comparison of FIGS. 1 and 2A show that the overall width Wf1 of the form 104, and the overall width Wf2 of the form 204, as well as the width of the first and second planar surfaces 140, 142, 240, and 242, can be varied as desired to accommodate the width, Ws, of sheet material. The width Ws of the sheet 102 as shown as a dimension that is less than the length of the form 104, 204, however, the width of the sheet material 102 can be substantially equal to the length Lf of the form 104, 204. In one embodiment the sheet material has a width Ws that has a length such that the sheet material is wound about the form 104, 204, at least once, and in alternative embodiments at least about five times, and at least ten times or more. The flat roll gift wrap product can include at least about 25 sq. ft. of sheet material, in another embodiment, at least about 50 sq. ft. sheet material, in yet another embodiment, at least about 100 sq. ft. or more of sheet material.

The combined surface area of the planar surfaces is greater than the combined surface area of the arcuate transitions. In another embodiment the combined area of sheet material supported the planar surfaces is greater than the combined surface area of sheet material supported by the arcuate transitions, and in another embodiment the combined area of the sheet material supported by one of the planar surfaces, for example planar surface 106, is greater than the combined area of sheet material supported by the arcuate transitions. The combined area of sheet material proximate the planar surfaces of the form can be substantially greater than the combined area of sheet material proximate the arcuate transitions, and the ratio can range, for example, from about 2:1 to about 20:1.

Figure 3B:
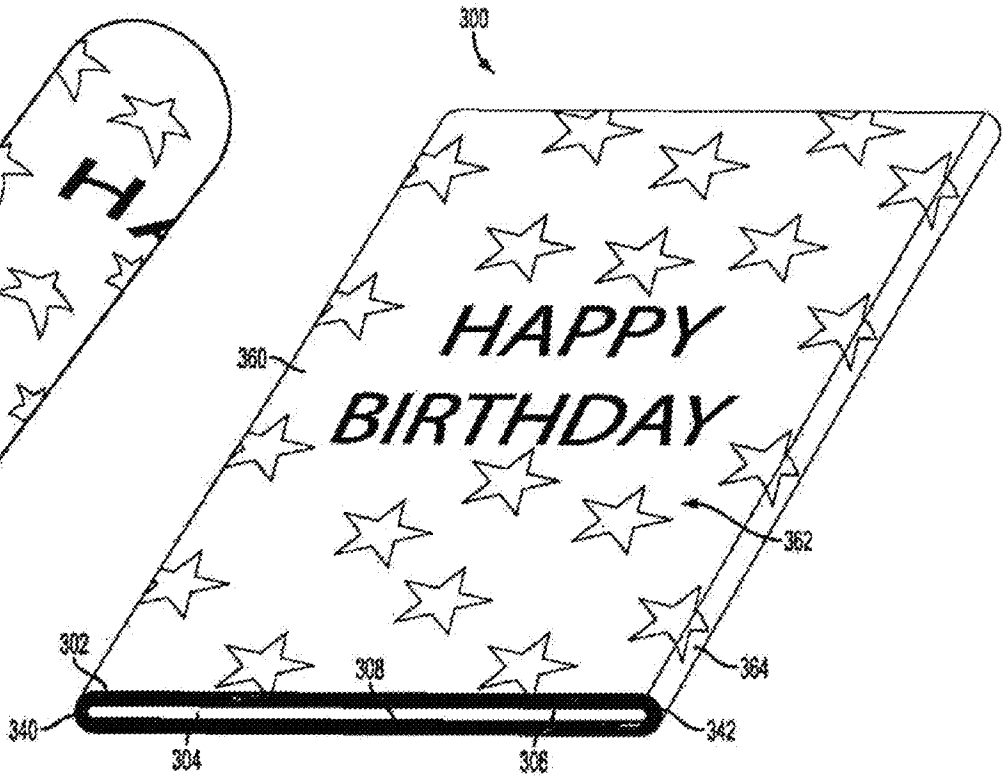
FIG. 3B is a perspective view of a flat roll gift wrap product illustrating the design pattern of the sheet material proximate the planar surface of the flat roll form, according to an embodiment of the invention.
Figure 3A:
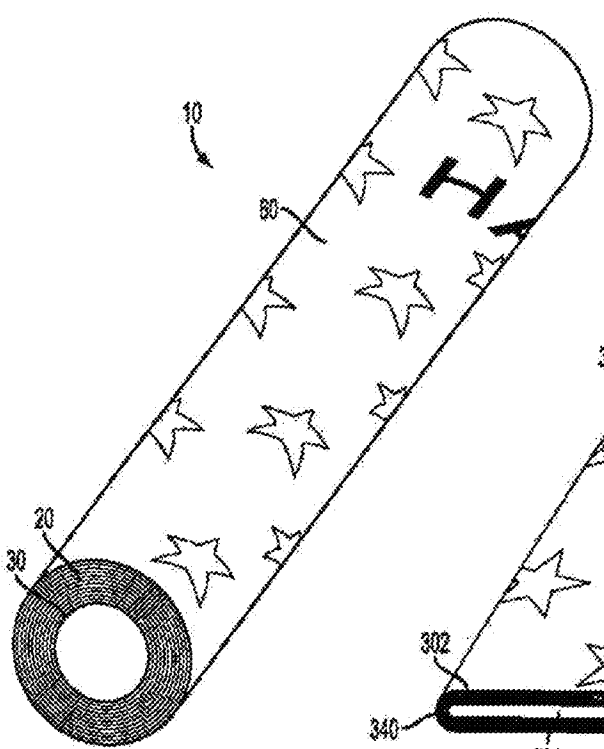
FIG. 3A PRIOR ART
FIG. 3A is a perspective view of rolled gift wrap of the prior art.

As apparent from FIGS. 1 and 2A, the width of the first and second planar surfaces 140, 142, and 240 and 242, respectively, can be varied as desired, and affords the advantage of making visible a substantial portion of the sheet material 102, and therefore, the overall appearance of any graphic indicia drawn over the planar surfaces. As also apparent by comparison to a prior art gift wrap roll 10 as shown in FIG. 3A of the prior art, the amount of print pattern or design example print pattern 360 on the sheet material 302 of gift wrap product 300 of FIG. 3B on the sheet material 20 that is easily discernable, is much greater on the flat roll gift wrap product 300 of FIG. 3B compared to the conventional roll 10 of the prior art (FIG. 3A). Also, where the applied print is in the form of a repeating pattern is common on gift wrap paper, the pattern is preferably visible in its entirety over at least one of the planar sides 306, 308, of the flat roll form 20 so that a shopper can clearly see the entire graphic design of the gift wrap. Where the graphic design is a repeating pattern, and depending upon the size and scale of the design, the design may even be repeated at least once and often many times over one of the planar sides of the flat roll form 304. Because gift wrap is selected for purchase primarily on the basis of the graphic design applied to the sheet material, the form 304 of the flat roll gift wrap product 300 results in greatly improved retail presentation of the product to the consumer.

The flat roll forms of the embodiments described above can be made of any suitable material, including but not limited to, for example, polymer, paper, cardboard, corrugated board or other organic or synthetic materials which are formable into the described shapes. In many cases the minimization of the total weight of the flat roll gift wrap product is desirable. For example, the flat roll form can be made of a polymer, such as a thermoplastic or a thermoset material that is a foam polymer, to provide for a flat roll form that has a lower weight compared to one made of solid polymer. In alternative embodiments, the flat roll form may include hollow portions, as will be further described.

The sheet material of the flat roll gift wrap products described above can be any flexible material in sheet form material in sheet form, such as, for example, paper or plastic. In another embodiment the sheet material is a non-textile material. The sheet material of the flat roll gift wrap products according to the various embodiments described herein may be used as sheet material that is not a wrapping material, for example, and can be used for purposes other than wrapping gifts.

Figure 4:
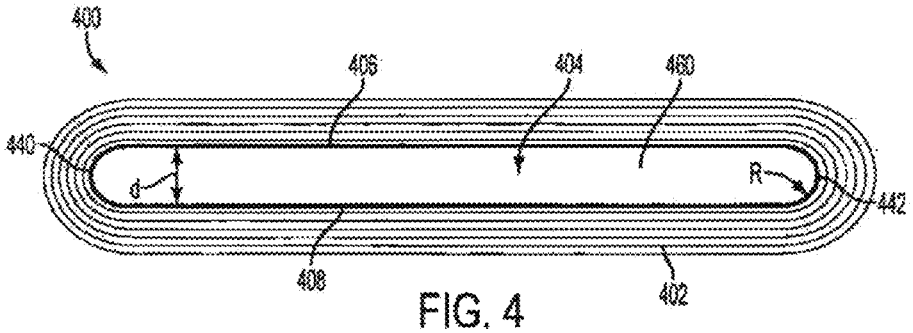
FIGS. 4-7 are cross-sectional views illustrating the core regions of the flat roll forms of various flat roll gift wrap products, according to embodiments of the invention.

FIGS. 4 through 7 are cross-section illustrations of various embodiments of the flat roll gift wrap product which illustrate the various form cores defined by the planar surfaces and the arcuate transitions of the form. FIG. 4 illustrates a homogeneous flat roll form 404 with opposed planar surfaces 406 and 408 and arcuate transitions 440, 442 that is formed by molding or extrusion or an alternative manufacturing process that can produce, for example, a solid, a porous, or at least a partially hollow core 460, such that the relative positions of the exterior surfaces and the shape of the sheet material 402 disposed thereabout is substantially maintained. The resistance of the form 404 against collapse or distortion due to the weight of the sheet material 402 can depend upon, among other variables, the strength of the material used in the forms, the design of the core 460, and as described above with respect to FIG. 1, the radius, R, of the arcuate transitions 440, 442. For example, depending on other factors the radius, R, can be large enough to avoid creasing or buckling of the form 404, or formation of any creases or folds in the sheet material 402, for example, in the region of or proximate to any of the arcuate transitions 440, 442 of the form 404. FIG. 4 shows that the planar surfaces 406, 408, are spaced apart a distance, d, substantially equal to the diameter of the arcuate transitions 440, 442, however, distance, d, can be greater to or less than the diameter of the arcuate transitions 440, 442.

Figure 5:
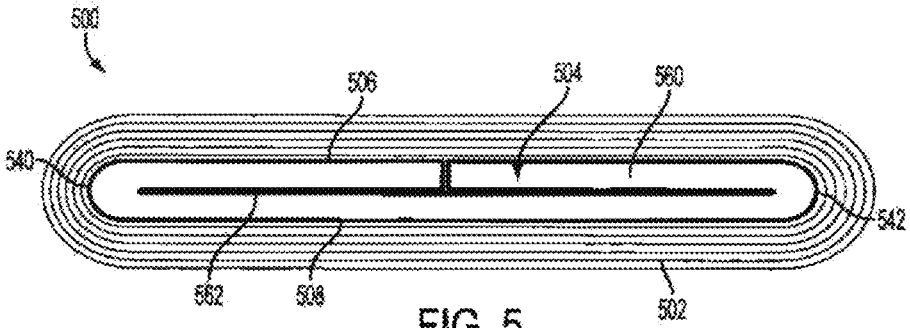

The embodiment of flat roll gift wrap product 500 of FIG. 5 includes a form 504 that is formed by a material having a planar surface, such as for example, a cardboard or paperboard or other formable material which has adequate rigidity so that the core 560 of the flat roll form 504 may include a minimal void 562, yet the planar surfaces 506, 508 and the arcuate transitions 540, 542 remain in the respective locations. For example, the planar surfaces 506, 508 do not collapse inwardly into the core 560 under the weight of the sheet material 502, nor do the arcuate transitions 540, 542 buckle inward toward the core 560 or bulge the planar surfaces 506, 508 under pressure from the sheet material 502 wound tightly against the arcuate transitions 540, 542.

To achieve the requisite rigidity of the material having a planar surface used to make the form 504, such as cardboard, fiberboard, plastic board or corrugated variations thereof, can be arranged with double thickness, i.e. at least two layers. The double or multiple thickness of the planar material can be thick enough to fill or substantially fill the core 560 so that there is very limited possibility, or no possibility, of collapse of the flat roll form 504. Additional folds can be made in the material used to make the form so that multiple layers of the material reside within the core 560 of the flat roll form 504. Material such as cardboard or foam board with skin covering can be scored on one side and folded along score lines to create the arcuate transitions 540, 542.

Figure 6:
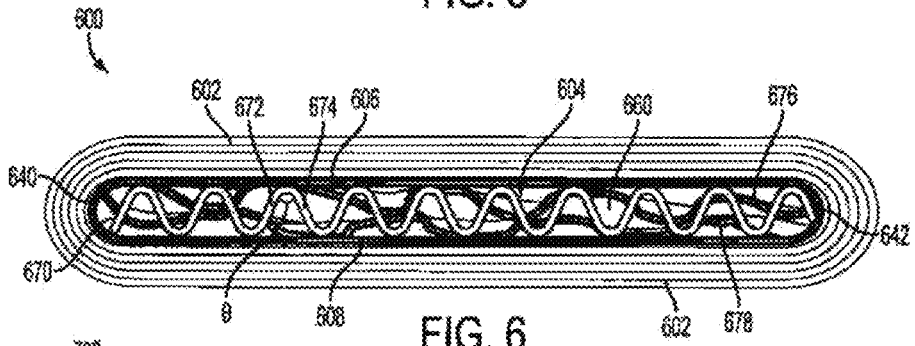

FIG. 6 illustrates a flat roll gift wrap product 600, wherein the form 604 includes a corrugated medium 670 within core 670, and the corrugated medium can have segments 672, 674, which are diagonally disposed relative to one another and form an angle, theta, which is less than about 90 degrees. In another embodiment, flat roll form 604 includes corrugations 676, 679, which abut within core 660, and which create spaced-apart regions or hollow portions of the core 660.

Figure 7:
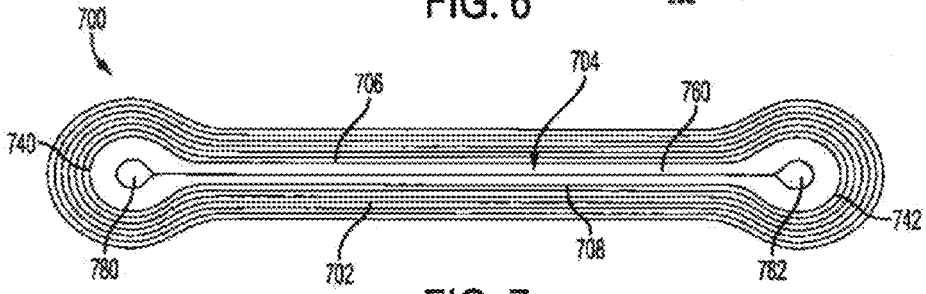

FIG. 7 illustrates another type of form 704 of a flat roll gift wrap product 700, wherein the core 760 in the form of a continuous piece which is pinched together to form the planar surfaces 706, 708, with unpinched or expanded areas forming the arcuate transitions 740, 742, at each lateral side of the form 704. The core 760 in can be made of any suitable material which can be so shaped, including but not limited to, for example, plastic, paper or fiber board or other moldable materials. As shown, portions of the core defined by the arcuate transitions are at least include openings 780, 782, and the core 760 is partially hollow. The sheet material 702 may generally follow the contour of the form 704 over the arcuate transitions 740, 742, and the slightly recessed planar surfaces 706, 708, and can present a substantial surface area of the sheet material 702 for retail display while also ensuring that no creases are formed in the sheet material, for example, along the arcuate transitions 740, 742.

FIGS. 8-14 illustrate various forms of packaging and display of the described flat roll gift wrap products, whereby a substantial portion of the gift wrap product is visible through the packaging, such as a transparent envelope as further described, and can be displayed as such in a generally vertical orientation upon or un connection with a retail display.

Figure 8:
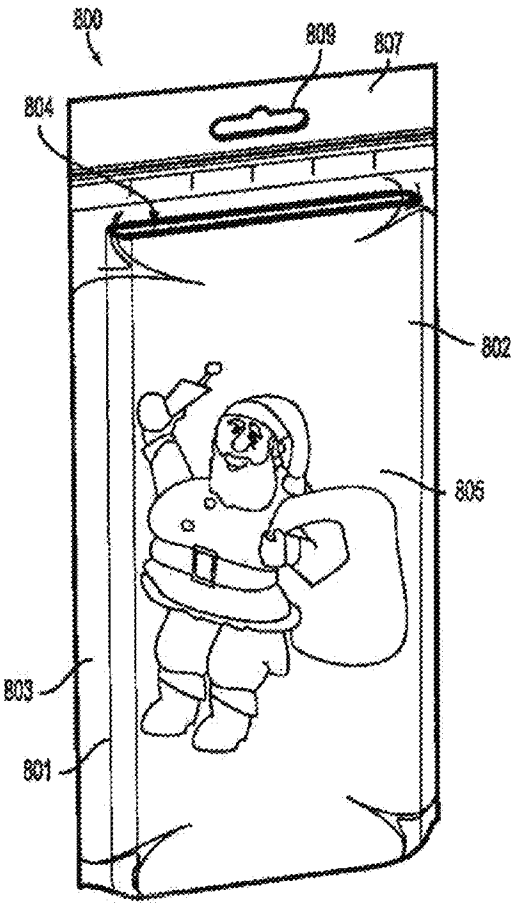
FIG. 8 is a perspective view of a flat roll gift wrap product which includes an envelope and a flat roll gift wrap unit disposed therein, according to an embodiment of the invention.

FIG. 8 illustrates a flat roll form product 800 includes a retail display container such as an envelope 803, which contains at least one gift wrap unit 801, where the gift wrap unit includes sheet material wound about the flat roll form. The gift wrap unit can includes any combination of the sheet materials and the flat roll forms described above with respect to the various embodiments of a flat roll gift wrap product. The envelope 803 can be made of cellophane, transparent cellophane, or any other suitable material. In one embodiment at least a portion of the sheet material 802 is visible to display a pattern 805 on the sheet material, and in another embodiment, at least one complete pattern of the sheet material is visible. In another embodiment the envelope 803 is sealed with a header 807 which can optionally include an opening 809 for suspension of the product 800 on a display hook. The header 807 can be made from the same material as and integral with the envelope, or as a separate piece such as cardboard which is encapsulated by the envelope 803. The flat planar form of the product 800 enables stacking of multiple products packaged in this way on one or more display hooks for a high-density display.

Figure 9:
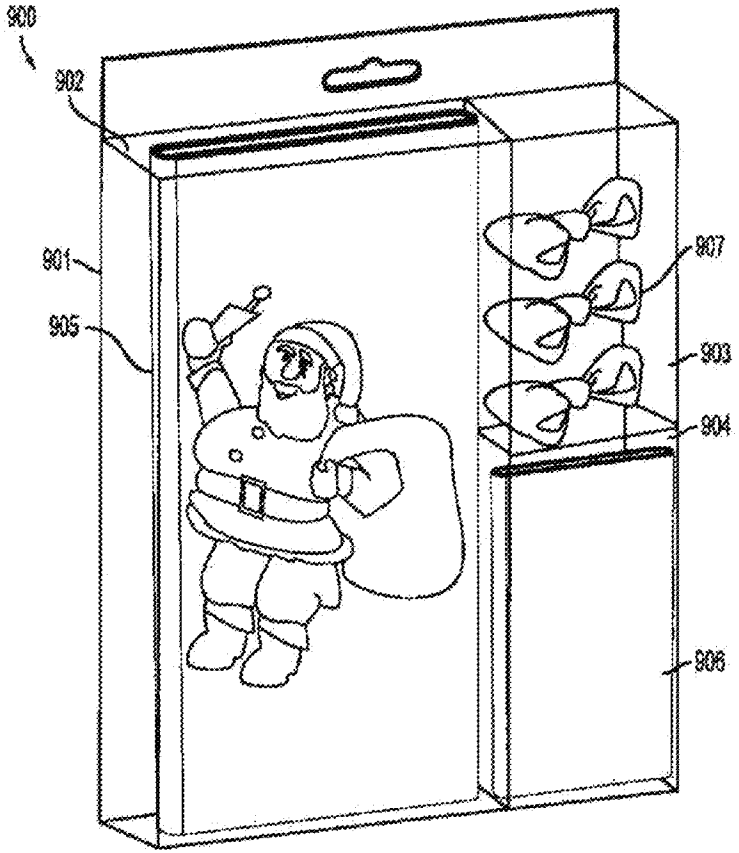
FIG. 9 is a perspective view of a flat roll gift wrap product which includes a multiple compartment container and at least one flat roll gift wrap unit disposed therein, according to an embodiment of the invention.

FIG. 9 illustrates a flat roll form product 900 in a retail display container 901, for example, in the form of a box which holds one or more flat roll gift wrap units 905, 906 in a first compartment 902, and a second compartment 904, respectively. The one or more gift wrap units 905, 906, can be different sizes and can reside in different size compartments 902, 904, however, the gift wrap units 905, 906, can be the same size, and the compartments 902, 904, can be the same size. The container 901 can also include additional compartments, for example, a third compartment 903 which can contain, for example, complimentary gift wrap items, such as, for example, bows, ribbons, gift tags and tissue paper.

Figure 11:
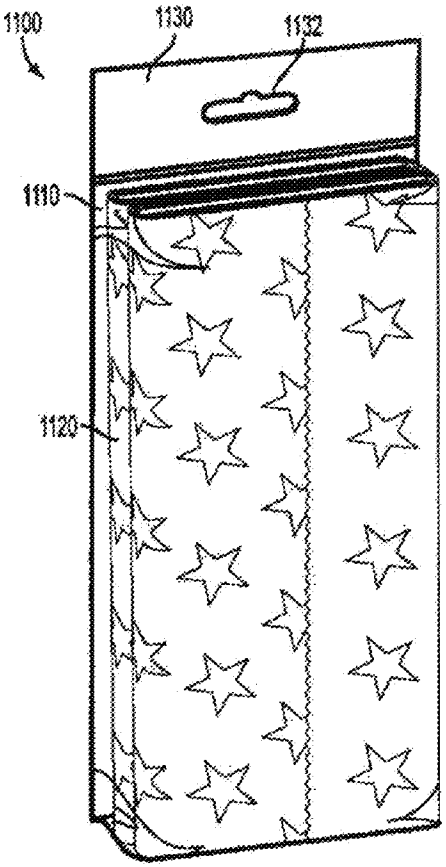
FIGS. 10-11 are perspective views of a flat roll gift wrap products that include at least two flat roll gift wrap units packaged in an envelope, according to an embodiment of the invention.
Figure 10:
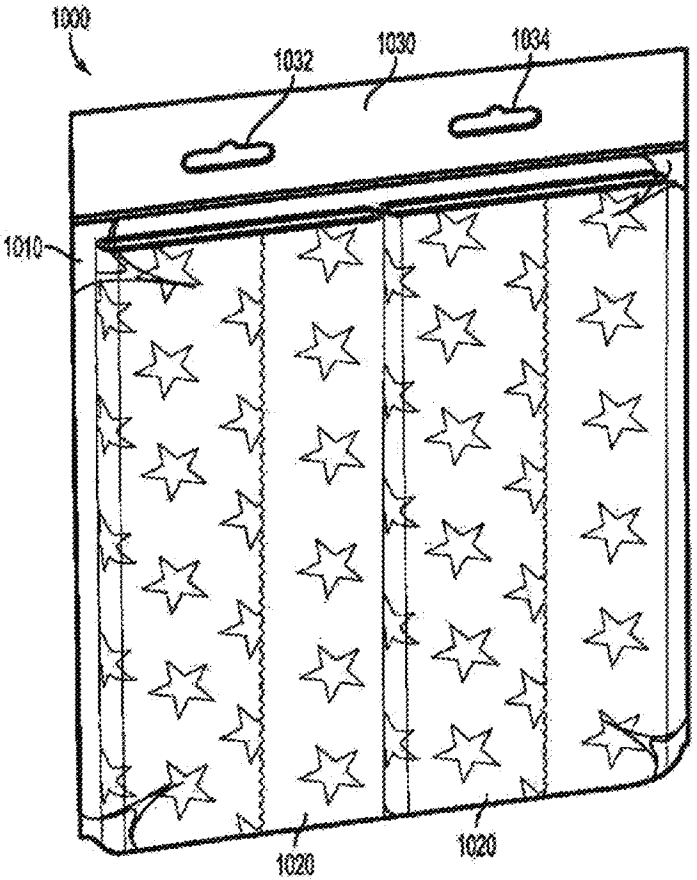

FIGS. 10 and 11 illustrate other forms of retail packaging and display of the flat roll gift wrap product 1000 having multiples gift wrap units 1020 and 1120, packaged side-by-side as shown in FIG. 10 within an envelope 1010, and stacked as shown in FIG. 11 within envelope 1110 which has sufficient depth. Both types of envelopes are sealed with a header section 1030, 1130 with an opening 1032, 1034, 1132 for suspended display on a hook. In packages of these types, the multiple flat roll packages 1020, 1120 can be of an assortment of designs, complimentary or not, and packaged in different numbers of multiples. The flat form of packages 1020, 1120 allows for densely arranged displays and bulk shipping with minimal air space. The flat roll form packages 1020, 1120 in the illustrated type retail display envelopes 1010 and 1110 maximize visibility to a shopper of the print patterns on the sheet material.

Figure 12:
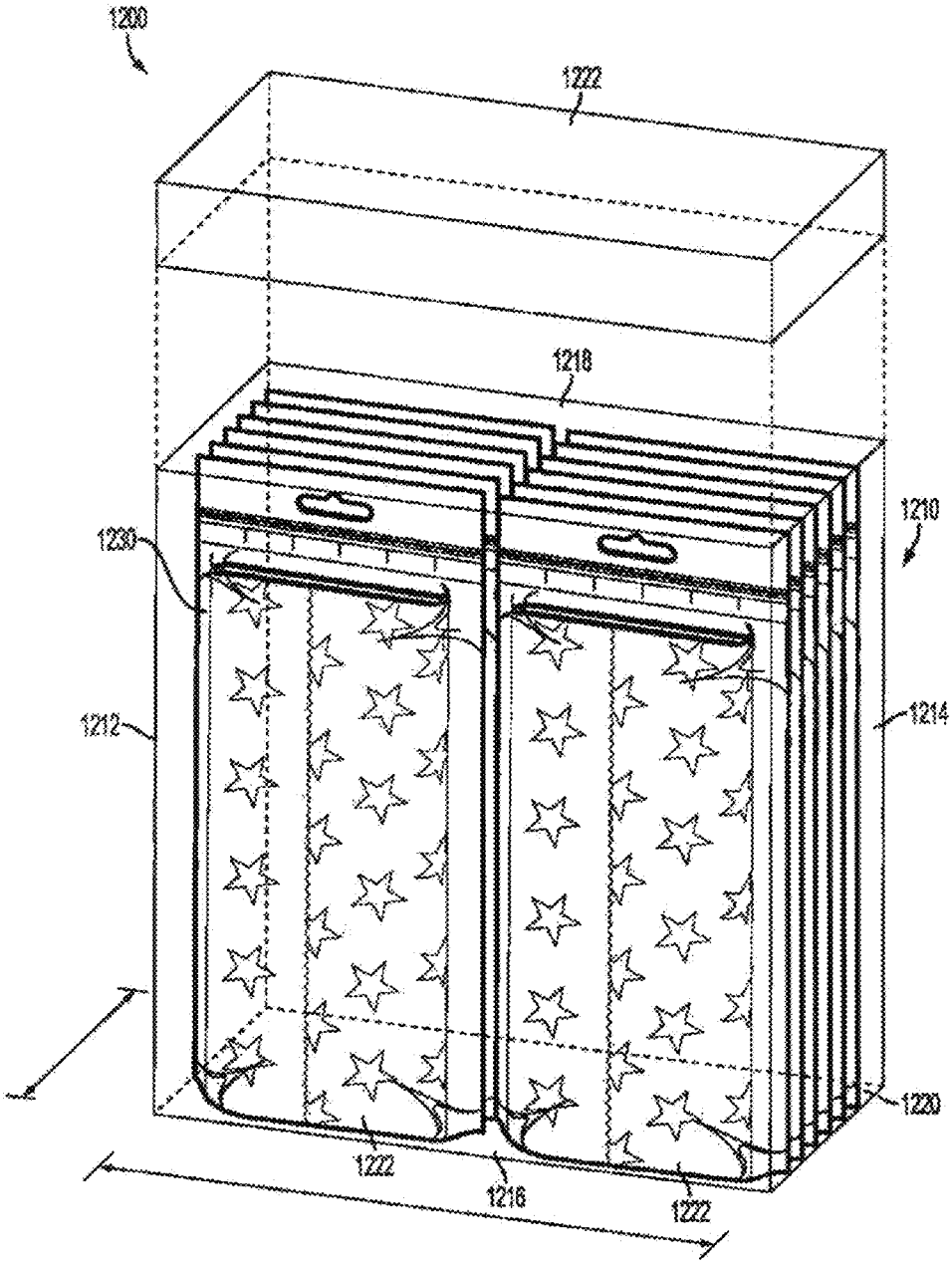
FIG. 12 is a perspective view of a flat roll gift wrap product that includes at container for supporting a plurality of flat roll gift wrap units according to an embodiment of the invention.

In another embodiment, FIG. 12 illustrates a flat roll gift wrap product 1200 which includes a container 1210 that supports one or more gift wrap units 1222. The gift wrap units 1222 include a flat roll form and sheet material of the several embodiments described above. The flat roll gift wrap product 1200 can optionally include a plurality of envelopes 1230 each of which contains one or more gift wrap units 1222. The gift wrap units 1222 may be arranged in a side-by-side arrangement, for example where the planar surfaces of the flat roll form are co-planar, or in a stacked arrangement, for example where the planar surfaces of the flat roll form are reside in different planes from unit to unit, inside the container 1210 within the container 1210, or within the envelopes 1230, or both. The gift wrap units of sheet material wound about the forms are compactly arranged in the container such that the sheet material proximate the arcuate transitions of the form has substantially no crease.

The container 1210 can be various shapes and sizes, such as, for example, one of several polygon shapes. As illustrated, the container is a shipping carton having at least four sides 1212, 1214, 1216, 1218, and a bottom 1220, and a lid 1222. The container 1210 can be made or various materials, including but not limited to, for example, cardboard, fiberboard, plastic, foam polymer, paper, corrugated board. The sheet density of the flat roll gift wrap product 1200 can be measured and defined as the sheet material volume divided by the container volume (i.e. sheet material volume/container volume), and can be substantially greater than the sheet density of conventional products, for example, a container, for example container 1210 that contains round gift wrap rolls of the prior art (FIG. 3A). The sheet density according to the example embodiments herein can be, for example, at least about 0.1, at least about 0.5, at least about 0.7, and in alternative embodiments, at least about 0.9. The unit density of the flat roll gift wrap product 1200 can be measured and defined as the flat roll unit volume divided by the container volume (i.e. flat roll unit volume/container volume), and can be substantially greater than the gift wrap unit volume of conventional products, for example, a container that contains round gift wrap rolls of the prior art (FIG. 3A). The gift wrap unit density according to the example embodiments herein can be, for example, at least about 0.5, at least about 0.7, at least about 0.9, and in alternative embodiments, at least about 0.95. Thus, the flat roll gift wrap product 1200 can provide for a more efficient and cost-effective method of shipment, with less air space within the container 1210 as compared to conventional gift: wrap products.

Figure 13:
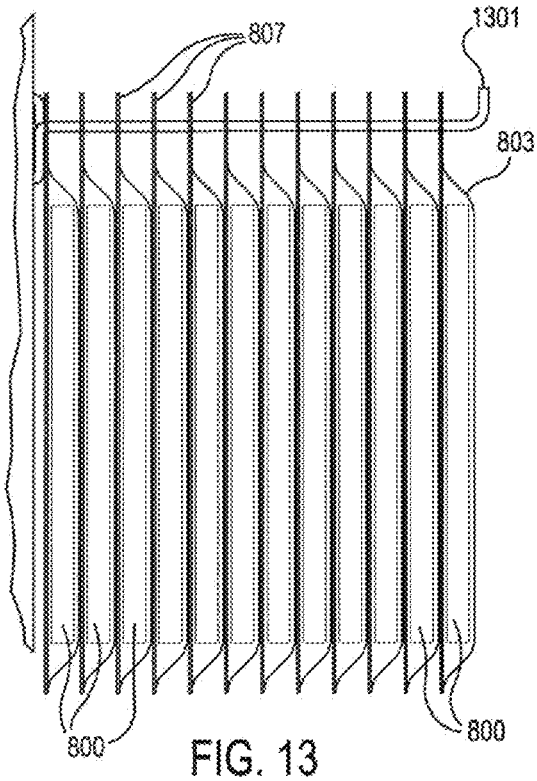
FIG. 13 is a side view of several flat roll gift wrap products each disposed within an envelope and displayed upon a horizontal retail display hook.

In another embodiment, FIG. 13 illustrates a plurality of packaged flat roll gift wrap products 800 suspended from a horizontal retail display hook 1301. This embodiment serves to overcome the difficulty in the retail industry of sufficiently displaying roll wrapping paper given a limited amount of floor space. Typically, roll wrap is displayed in an upright position, each roll placed within a large cardboard box or other container that is located on the retail floor or bottom shelf. This configuration requires a large amount of floor space. Also, since the units are placed on the floor or bottom shelf, it is difficult for the consumer to view the pattern or design of the wrapping paper wound upon the roll. Winding the wrapping paper upon a flat roll form and packaging it within a clear envelope 803 having a retail header 807 with an opening contained therein, allows retailers to move the roll wrap off of the retail floor and onto a hook, potentially at eye level, thereby instantly decreasing the amount of floor space required to display roll gift wrap. It also provides the retailer with added flexibility in positioning the roll wrap within the store. For example, roll wrap can row be displayed in several different areas of the store and potentially at the cash wrap where most impulse purchases occur. In a preferred embodiment, the retail display hook 1301 is a horizontal rod which at a first end is configured to be inserted into a mating or peg board or other suitable display panel, and at a second end is slightly upturned, so as to prevent merchandise from falling off the hook. Depending on the length of the hook, several packaged flat roll gift wrap products may be displayed in a parallel fashion by placing the hook 1301 through the opening contained within the package retail display header 807.

Any of the various described embodiments of the flat roll gift wrap products can be displayed on or in connection with the displays as described with reference to FIGS. 13 and 14 or any other type of display having the general configuration of a generally horizontally disposed hook or bracket which extends from a generally vertical display wall, whereby one or more flat roll gift wrap products are displayed in a generally vertical orientation.

Figure 14:
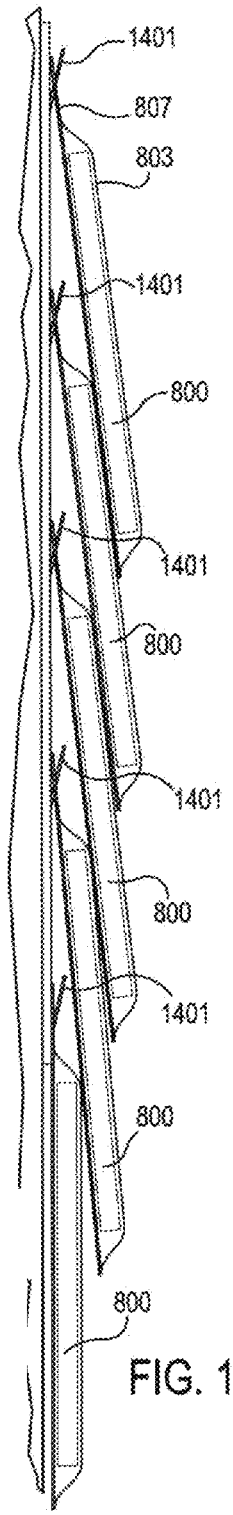
FIG. 14 is a side view of several flat roll gift wrap products each disposed within an envelope and displayed in cascading fashion on several generally vertical retail display hooks.

In yet another embodiment, FIG. 14 illustrates a plurality of packaged flat roll gift wrap products 800 suspended from a vertical retail display rod having a plurality of generally vertical display hooks 1401 spaced apart to present each product in a shingled or cascading or overlapping arrangement. This embodiment also decreases the floor space required to display the roll wrap but also allows for simultaneous viewing of at least a portion of several flat roll wrap products. Packaging the wrapping paper in a flat roll configuration 804 within a clear envelope 803 a retail header 807 with an opening 809 thereon and displaying said package on a generally vertical retail hook provides the consumer with instant visibility to several rolls of paper and provides the retailer with a flexible, appealing display requiring minimal floor space. In a preferred embodiment, the retail display rod contains several hooks 1401 that are in a generally vertical array. The retail display rod is configured at one end to be inserted into or supported by a mating panel or other suitable retail display panel. Each packaged flat roll gift wrap product 800, i.e., gift wrap unit, is inserted onto or engaged with a hook 1401 on the display rod via the opening in the package retail display header 807. Alternatively, the retail display header 807 of each packaged flat roll gift wrap product may be inserted into a clip mechanism on the retail display rod. In this embodiment, the vertical spacing of the hooks or clips 1401 is preferably less than a length dimension of the gift wrap units, so that the gift wrap unit which is above the adjacent gift wrap unit overlaps the lower gift wrap unit in a roofing shingle type manner. This creates additional dimension to the vertical display, and presents the face of each gift wrap unit at a desirable viewing angle.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

What is claimed is:

1. A retail display of flat roll gift wrap products comprising:

a plurality of forms comprising two substantially planar opposed surfaces generally rectangular in shape having side edges and ends which are aligned and arcuate transitions between the aligned edges, the arcuate transitions having a generally arcuate and convex form which projects laterally outboard of the aligned edges;

a plurality of sheet material wound about a width of each form over the planar opposed surfaces and the arcuate transitions, the plurality of sheet material following the generally arcuate and convex form of the arcuate transitions and planar surfaces of the planar opposed sides; and a plurality of envelopes which each contain a first compartment and a second compartment, the first compartment containing at least one of the plurality of sheet material wound about one of the plurality of forms and the second compartment containing at least one complimentary gift wrap item selected from the list of bows, ribbons, gift tags and tissue paper, wherein the each envelope is suspended by a header which seals each envelope and contains an opening thereon for suspension from a generally horizontal display hook which is inserted through the opening in the header.

2. The retail display of flat roll gift wrap products of claim 1, wherein a plurality of envelopes are suspended by the header of each envelope from the display hook.

3. The retail display of flat roll gift wrap products of claim 1, wherein at least a portion of the sheet material is visible through the envelope.

4. The retail display of flat roll gift wrap products of claim 1, wherein the first compartment of the envelope contains two or more units of the sheet material wound about the form.

5. The retail display of flat roll gift wrap products of claim 4, wherein the two or more gift wrap units are stacked within the first compartment of the envelope.

6. The retail display of flat roll gift wrap products of claim 1, wherein the form is made of a material selected from the group consisting of: paper, cardboard, corrugated cardboard, polymer and wood.

7. A retail display of flat roll gift wrap products comprising:

a plurality of flat roll gift wrap products comprising a form having two substantially planar surfaces generally rectangular in shape and having side edges and ends which are aligned and arcuate transitions between the aligned edges, the arcuate transitions having a generally arcuate and convex form which projects laterally outboard of the aligned edges and sheet material wound about a width of the form over the planar opposed sides and the arcuate transitions, the sheet material following the generally arcuate and convex form of the arcuate transitions and planar surfaces of the planar opposed sides; and a plurality of envelopes which each contain one of the plurality of flat roll gift wrap products each envelope also having a header which seals the envelope and through which a transverse opening is formed;

wherein each of the plurality of envelopes are suspended from a generally vertically oriented display fixture having attachment means inserted through the header of each envelope, each of the plurality of envelopes being positioned in a cascading fashion wherein a portion of each of the plurality of flat roll gift wrap products is visible through the respective envelope.

8. The retail display of flat roll gift wrap products of claim 7, wherein at least a portion of the sheet material is visible through the envelope.

9. The retail display of flat roll gift wrap products of claim 7, wherein the envelope contains two or more gift wrap units.

10. The retail display of flat roll gift wrap products of claim 9, wherein each of the two or more gift wrap units are in a side by side arrangement within the envelope.

11. The retail display of flat roll gift wrap products of claim 9, wherein the two or more gift wrap units are stacked within the envelope.

12. The retail display of flat roll gift wrap products of claim 9 further comprising:

a container; and at least one gift wrap unit supported by the container.

13. The retail display of flat roll gift wrap products of claim 9, wherein the envelope contains a first compartment and a second compartment, the sheet material wound about the form is disposed within the first compartment and the second compartment contains at least one complimentary gift wrap item selected from the list of bows, ribbons, gift tags and tissue paper.

14. The retail display of flat roll gift wrap products of claim 9, wherein the form comprises a material selected from the group consisting of: paper, cardboard, corrugated cardboard, polymer and wood.

15. A plurality of flat roll form products in combination with a retail display, wherein the plurality of flat roll form products each have a generally planar configuration with sheet material wound about a generally flat roll form, and are contained within an envelope which is made of a transparent material whereby the sheet material is visible through the envelope to display a pattern on the sheet material, each envelope being sealed with a header which has an opening thereon, the plurality of flat roll form products being suspended from a plurality of retail display hooks which are arranged in a generally vertical array and spaced a vertical distance apart which is less than a length of the flat roll form products, whereby a portion of each flat roll form product which is supported by a retail display hook above a vertically adjacent flat roll form product overlaps a lower adjacent gift wrap unit.

* * * * *